United States Patent [19]

Graham

[11] Patent Number: 4,695,830

[45] Date of Patent: Sep. 22, 1987

[54] WIRE RUNTOGETHER SENSOR

[75] Inventor: Randall C. Graham, Nashville, Tenn.

[73] Assignee: Essex Group, Inc., Fort Wayne, Ind.

[21] Appl. No.: 788,903

[22] Filed: Oct. 18, 1985

[51] Int. Cl.[4] ..... G08B 21/00

[52] U.S. Cl. ..... 340/677; 200/61.13

[58] Field of Search ..... 340/540, 677; 200/61.13, 61.18, 61.41, 61.42; 28/187

[56] References Cited

U.S. PATENT DOCUMENTS

| | | | |
|---|---|---|---|
| 2,586,960 | 2/1952 | Kivley et al. | 340/677 |
| 2,685,626 | 8/1954 | Zwack | 340/677 X |
| 3,059,309 | 10/1962 | Blanton | 28/187 |

*Primary Examiner*—Glen R. Swann, III
*Assistant Examiner*—Thomas J. Mullen, Jr.
*Attorney, Agent, or Firm*—Francis J. Maguire, Jr.

[57] ABSTRACT

A runtogether sensor comprising a balanced beam having a plurality of tines for insertion between a plurality of parallel wires in motion for sensing a pair of stuck together wires by means of a switch associated with the balanced beam for providing a signal indicative of a runtogether condition to an annunciator which provides verbal announcements of runtogether conditions, as well as other conditions to maintenance personnel for immediate corrective action.

3 Claims, 3 Drawing Figures

FIG. 1
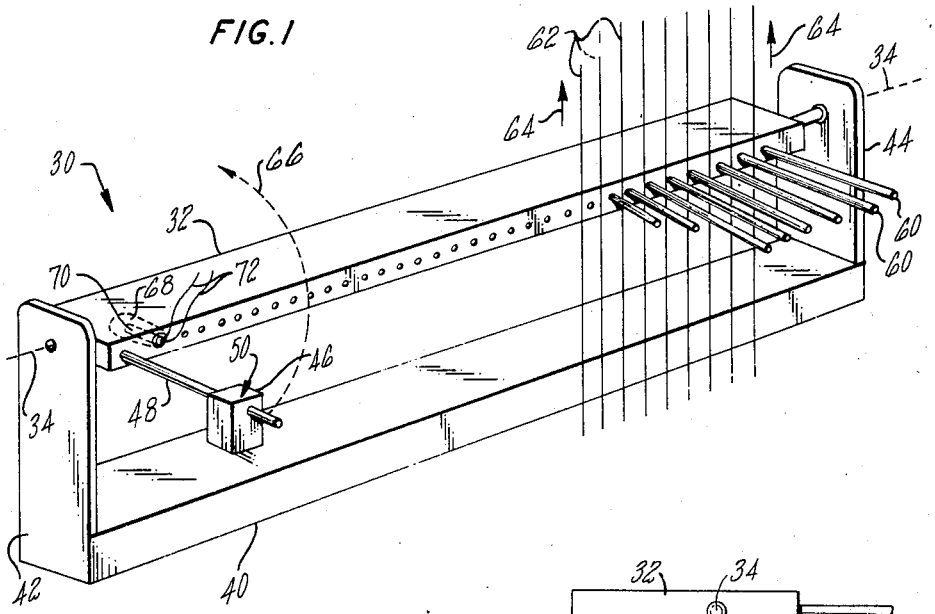
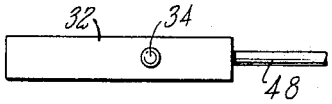
FIG. 3
FIG. 2
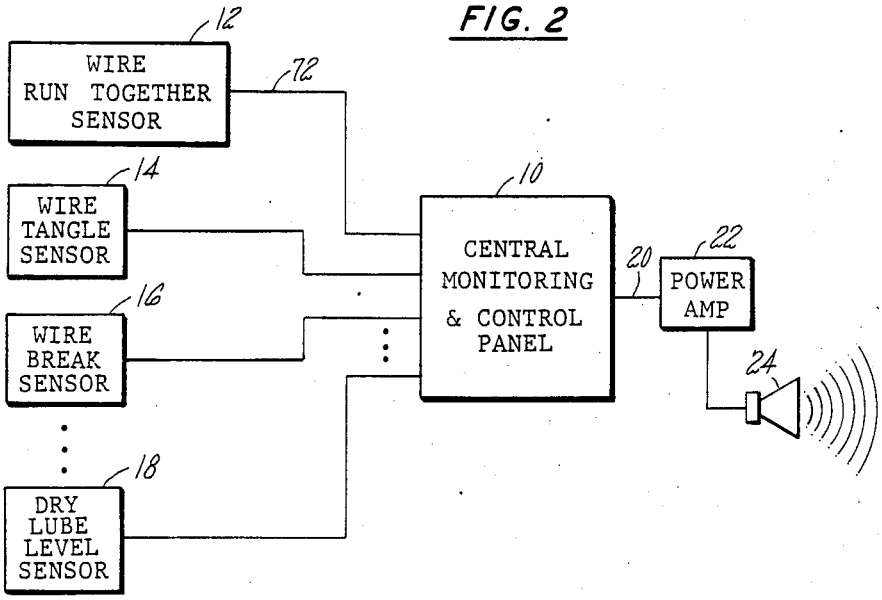

WIRE RUNTOGETHER SENSOR

CROSS REFERENCE TO RELATED APPLICATIONS

The invention described herein may employ some of the teachings disclosed and claimed in commonly owned copending applications filed on even date herewith filed by Graham, Ser. No. 788,990, entitled LOW COST VERBAL ANNUCIATIOR, Ser. No. 788,901 ( now U.S. Pat. No. 4,635,046), entitled A WIRE TANGLE SENSOR, Ser. No. 788,902 (now abandoned), entitled A WIRE TANGLE SENSOR, and Ser. No. 788,904 (now U.S. Pat. No. 4,644,332), entitled A DRY LUBE LEVEL SENSOR. Each of the above-listed copending applications are hereby expressly incorporated by reference.

TECHNICAL FIELD

This invention relates to process alarm systems and particularly to a special purpose sensor for a verbal annunciator system.

BACKGROUND ART

Modern wire manufacturing processes often require fast response and quick corrective action to prevent production delays. For example, recently developed high speed wire manufacturing processes in which a heavy gage wire is drawn down to a smaller size, e.g., #12 AWG to #22 AWG, can experience faults which, if not rapidly corrected, can cause expensive production shutdowns. Factories for making such wire may consist of a large number of such production units spread over a wide expanse and staffed only by a small number of maintenance personnel on an around the clock basis. Unfortunately, present alarming systems for detecting faults and producing audio and visual alarms are sometimes inadequate in providing sufficient information to immediately direct the maintenance personnel to the source of the problem in time to prevent production shutdowns.

Copending application Ser. No. 788,990 entitled LOW COST VERBAL ANNUNCIATOR, discloses, but does not independently claim a wire runtogether sensor for use with a low cost verbal annunciator system. This application discloses and claims such a wire runtogether sensor.

DISCLOSURE OF INVENTION

The object of the present invention is to provide a wire runtogether sensor for sensing wires in a wire fabrication process which have inadvertently become stuck together in an enameling and curing process so that such a condition may be verbally annunciated to maintenance personnel for immediate corrective action before costly production shutdowns occur.

According to the present invention, a runtogether sensor for sensing enameled wires stuck together in a baking process comprises a beam balanced on a longitudinal axis thereof supported between two opposed support members of a bracket mounted in proximity to a plurality of parallel wires undergoing wire fabrication. A plurality of parallel rigid tines extend outward from the beam orthogonal to the axis for insertion between the plurality of parallel wires in motion undergoing fabrication. A switch is responsive to movement of the beam about its longitudinal axis induced by a tine forced in motion by a pair of stuck together wires moving past the tine. The switch provides a binary signal in a state indicative of a runtogether condition. The switch may be a mercury switch inserted in the beam, a proximity switch positioned near the beam, a micro-switch in contact with the beam, or any of a wide variety of switches available.

In further accord with the present invention, a wire runtogether sensor may be employed in a low cost verbal annunciator system which is responsive to a plurality of sensors for sensing abnormal wire fabrication problems and providing a verbal announcement to maintenance personnel of such problems before they cause extended production shutdowns.

The wire runtogether sensor of the present invention provides a simple and inexpensive method for avoiding costly production shutdowns due to stuck together wires in a wire fabrication process.

These and other objects, features and advantages of the present invention will become more apparent in light of the detailed description of a best mode embodiment thereof, as illustrated in the accompanying drawings.

BRIEF DESCRIPTION OF DRAWINGS

FIG. 1 is a simplified perspective illustration of a runtogether sensor, according to the present invention:

FIG. 2 is an illustration of a runtogether sensor for use with a plurality of sensors for sensing production problems in a wire fabrication process in a system for verbally annunciating abnormal condition messages to maintenance personnel; and FIG. 3 is an edge on view of the beam of FIG. 1.

BEST MODE FOR CARRYING OUT THE INVENTION

FIG. 2 is an illustration of a central monitoring and control panel 10, for monitoring the condition of a plurality of remote sensors and for providing a verbal output signal on a line 20 to a power amplifier 22 and speaker 24 for annunciating a verbal alarm message in the presence of a sensed abnormal condition. The sensors may include but are not limited to a wire runtogether sensor 12, a wire tangle sensor 14, a wire break sensor 12, and a dry lube level sensor 18. Each sensor triggers an associated cassette tape player within the central panel 10, each of which provides a unique verbal message signal on the line 20 for annunciation. The system is fully disclosed in copending application Ser. No. 788,990, entitled LOW COST VERBAL ANNUNCIATOR.

During fabrication, wires are generally produced in parallel so that during enameling and curing in an oven there may occur a stuck together condition by which two or more parallel wires become bonded together over a short length of wire. FIG. 1 is a perspective illustration of a runtogether sensor 30 which includes a balance beam 32, balanced along a longitudinal axis 34 thereof on a bracket 40 which includes two opposing support members 42, 44. The balance beam 32 is balanced by means of a balance weight 46 extending outwards from the balance beam along a tine 48. A setscrew 50 permits the proper positioning of the balance weight to effect a fixed desired balanced condition. It will be noted that the balance beam 32 has its longitudinal axis offset somewhat forward from what would be a symmetrical positioning down the center of the beam. (See FIG. 3). This is to offset the weight of a plurality of rigid tines 60, only a few of which are shown in FIG. 1. They extend outwardly from an edge of the balance beam 32 orthogonal to the balancce axis 34. The tines are intended for insertion between a plurality of moving wires 62 undergoing fabrication. The wires being fabricated are in motion in a direction indicated by arrows 64. If any two or more wires become bonded together in the enameling and curing oven they will "catch" on one of the tines 60 and the balance beam will be forced to pivot about its axis as shown by a dotted line 66 until the bonded wires pass by and the "caught" tine is freed.

A cavity 68 in the balance beam may be used to retain a mercury switch 70 having a pair of output leads 72 for providing a signal to the central monitoring and control panel 10 of FIG. 2. Of course, it will be understood that a proximity sensor, microswitch or the like would do as well, although probably at a higher expense.

Although the invention has been shown and described with respect to a preferred embodiment thereof, it will be understood by those skilled in the art that the foregoing and various other changes, omissions and deletions in the form and detail thereof may be made therein without departing from the spirit and scope of this invention.

I claim:

1. A runtogether sensor, comprising:

two opposed vertical support members;

a beam supported between the support members;

a plurality of parallel rigid tines extending outwardly horizontally from the beam for insertion between a plurality of vertical parallel wires in motion undergoing enamelling;

a counter-balance motion on the beam for precisely balancing the beam such that the tines are horizontal; and a switch, responsive to movement of the beam induced by a tine forced in motion by a pair of stuck together wires moving past the tine for providing a signal indicative of a runtogether condition.

2. The runtogether sensor of claim 1, wherein said switch is a mercury switch.

3. The runtogether sensor of claim 1, wherein the beam is supported on an axis off-center from an axis at the center of the beam's cross-section, the off-center axis being on the tine side of the cross-section in order to permit the greater part of the beam weight on the other side of the cross-section to offset the weight of the tines, thereby maintaining the tines in horizontal balance.

* * * * *

UNITED STATES PATENT AND TRADEMARK OFFICE

CERTIFICATE OF CORRECTION

PATENT NO. : 4,695,830

DATED : September 22, 1987

INVENTOR(S) : Randall C. Graham

It is certified that error appears in the above-identified patent and that said Letters Patent is hereby corrected as shown below:

| | |
|---|---|
| Column 4, line 4. | Cancel "outwardly" and substitute -- outward -- |
| Column 4, line 8. | Cancel "motion" and substitute -- mounted -- |

Signed and Sealed this

Second Day of August, 1988

*Attest:*

*Attesting Officer*

DONALD J. QUIGG

*Commissioner of Patents and Trademarks*